United States Patent [19]

Sluijterman et al.

[11] 4,396,897

[45] Aug. 2, 1983

[54] CATHODE RAY TUBE HAVING PERMANENT MAGNETS FOR MODULATING THE DEFLECTION FIELD

[75] Inventors: Albertus A. S. Sluijterman; Werner A. L. Heijnemans; Nicolaas G. Vink; Joris A. M. Nieuwendijk, all of Eindhoven, Netherlands

[73] Assignee: U.S. Philips Corporation, New York, N.Y.

[21] Appl. No.: 326,241

[22] Filed: Dec. 1, 1981

[30] Foreign Application Priority Data

Dec. 5, 1980 [NL] Netherlands ..... 8006628
Oct. 19, 1981 [NL] Netherlands ..... 8104735

[51] Int. Cl.[3] ..... H01F 1/00
[52] U.S. Cl. ..... 335/212; 335/210
[58] Field of Search ..... 335/210, 212, 213

[56] References Cited

U.S. PATENT DOCUMENTS 4,109,220 8/1978 Peart ..... 335/212
4,197,487 4/1980 Takemaka et al. ..... 335/212
4,231,009 10/1980 Barkow ..... 335/212

*Primary Examiner*—George Harris
*Attorney, Agent, or Firm*—Robert J. Kraus

[57] ABSTRACT

The stringent requirements regarding convergence (in color display tubes) and spot quality in monochrome display tubes are met by deflection units which produce dynamic multi-pole fields which are strongly modulated. Static multipole fields, which have a dynamic component when an electron beam passes therethrough, are used in cathode ray tube-deflection unit combinations to simulate, a strong modulation of the dynamic multipole deflection fields. In one combination, the production of a negative static eightpole field in the center of the deflection area improves spot quality.

26 Claims, 23 Drawing Figures

CATHODE RAY TUBE HAVING PERMANENT MAGNETS FOR MODULATING THE DEFLECTION FIELD

BACKGROUND OF THE INVENTION

The invention relates to a cathode ray display tube of the type having a rectangular display screen, an electron gun system to generate at least one electron beam, and a deflection unit is connected on the display tube in such manner that their longitudinal axes coincide. The deflection unit comprises a set of line deflection coils which, upon energization deflect the electron beam in a first direction and a set of field deflection coils which upon energization deflect the electron beam in a direction transverse to the first direction. The sets of deflection coils upon energization, generate a dynamic magnetic multipole field comprising at least a dipole component and a sixpole component.

In monochrome cathode ray display tubes the electron gun system is adapted to generate one electron beam incident to the display screen, whereas in colour display tubes the electron gun system is designed to generate three electron beams which converge on the display screen. The description hereinafter will for the sake of simplicity relate to the deflection of one electron beam.

The deflection unit for deflecting the electron beam is used to deflect the electron beam in one or in the other direction from its normal undeflected straight path, so that the beam impinges upon selected points on the display screen to provide visual presentations. By varying the magnetic deflection fields in a suitable manner, the electron beam can be moved upwards or downwards and to the left or to the right over the display screen. By simultaneously modulating the intensity of the beam a visual presentation of information or a picture can be formed on the display screen. The deflecting unit attached to the neck portion of the cathode ray tube comprises two sets of deflection coils enabling deflection of the electron beam in two directions which are transverse to each other. Each set comprises two coils which are arranged on oppositely located sides of the tube neck, the sets being shifted relative to each other through 90° about the tube neck. Upon energization the two sets of deflection coils produce orthogonal deflection fields. The fields are essentially perpendicular to the path of the undeflected electron beam. A cylindrical core of a magnetizable material which closely engages the sets of deflection coils when the two sets of deflection coils are of the saddle type, is used to concentrate the deflection fields and to increase the flux density in the deflection area.

In order to satisfy certain requirements regarding picture quality, the (dynamic) magnetic deflection fields should often be modulated strongly. For example, the stringent convergence requirements in three-in-line colour television systems necessitate, in addition to a strong positive magnetic sixpole component on the gun side of the field deflection field, a strong negative magnetic sixpole component in the centre of the field deflection field. Monochrome display systems of high resolution require, in addition to a positive magnetic sixpole component on the screen side of both the line and the field deflection field, a negative magnetic sixpole component in the centre for good spot quality. In systems having a large deflection angle it is particularly difficult to realize the required modulations by only the wire distribution of the sets of deflection coils, if possible at all, the deflection unit often becomes too expensive.

SUMMARY OF THE INVENTION

It is an object of the invention to provide a deflection unit for use with a cathode ray display tube with which strongly modulated multipole fields can be simulated without making the wire distribution of the sets of deflection coils overly complex.

For that purpose, a cathode ray tube having a deflection unit of the type mentioned in the opening paragraph is characterized according to the invention in that the deflection unit comprises at least one permanent magnet device which is provided coaxially with the longitudinal axis of the deflection unit between the entrance side and the exit side of the deflection area, the device generating a non-varying magnetic n-pole field for simulating a modulation of the dynamic n-2 pole deflection field (n=4, 8, 12 or 16).

The invention is based on the fact that a static multipole field has a dynamic component when an electron beam passes eccentrically through it. For example, a static eightpole field provides a dynamic sixpole component, a static twelvepole field provides a dynamic tenpole component, etc.

A static multipole field can be generated by means of a number of discrete permanent magnets placed along the circumference of a circle having its centre on the longitudinal axis of the deflection unit, or by means of an annular member (like a ring or band) of a permanent magnetizable material having an aperture, which is adapted to fit around the outer surface of the display tube. The annular member has at least two north poles and two south poles formed by magnetization.

When the static multipole field is generated by means of discrete permanent magnets, they can be provided, for example, on the inner or outer surface of a synthetic resin support which is adapted to bear at least one of the sets of deflection coils. When the static multipole field is generated by means of a permanently magnetized ring or band, it may be secured, for example, in a groove which is provided in the inner or outer surface of a synthetic resin support, which support is adapted to bear at least one of the sets of deflection coils.

Alternative placements for the separate magnets or multipole magnetized rings and bands include locating them between the sets of line and field deflection coils, and locating them against the inner surface of the cylindrical core.

The static multipole field can be generated at various axial positions in the deflection area. When a static negative eightpole field is generated in the area around the deflection point in conjunction with a dipole main deflection field, it has the same effect on an electron beam as a barrel-shaped main deflection field. This means that it simulates a negative dynamic sixpole component.

The above effect is very useful in monochrome display tube deflection unit systems which should have both minimum spot growth and an undistorted raster presentation. An undistorted raster can be produced by generating a dynamic positive sixpole component on the front of both the line and field deflection fields, while minimum spot growth can be ensured by generating a negative static eightpole in the centre of the line and field deflection field. If a dynamic negative sixpole component is already present in the centre of the field its effect is intensified by the addition of a negative static eightpole, but, as will be explained in detail hereinafter, it is particularly advantageous when a positive dynamic sixpole component is generated along the whole length of the deflection field and the effect of this component in the centre is attenuated by the static eightpole component.

It is possible that the means to generate the static eightpole field in the centre do not only generate an eightpole field but also introduce a quadrupole field component. This can be compensated for in a simple manner by generating a quadrupole field component of opposite sign at the entrance side of the deflection field.

When rings of permanent magnetizable material are used, it is possible to selectively adjust the magnetization in the final phase of manufacture of each deflection unit.

It is then possible to magnetize any ring so that any astigmatic errors caused by spreadings of the line and/or field deflection coil sets, during manufacture, can be compensated for.

BRIEF DESCRIPTION OF THE DRAWING

The invention will now be described in greater detail, by way of example, with reference to the drawing.

DESCRIPTION OF THE PREFERRED EMBODIMENTS

Figure 1:
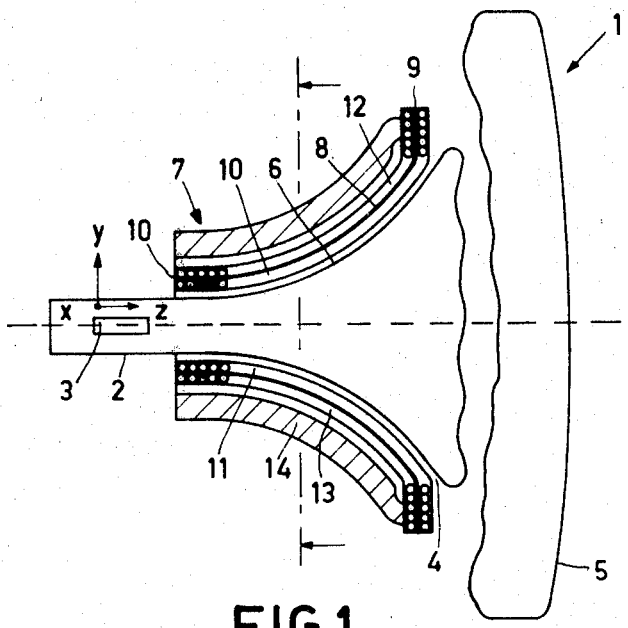
FIG. 1 is a diagrammatic cross-sectional view (taken on the y-z plane) of a cathode ray tube having a deflection unit.

FIG. 1 is a cross-sectional view taken along the y-z plane of a cathode ray tube 1 having an envelope 6 which varies in cross-sectional area from a narrow neck portion 2 in which an electron gun system 3 is mounted to a wide cup-shaped portion 4 which has a display screen 5. A deflection unit is assembled on the tube at the transition between the narrow and wide portions. The deflection unit 7 comprises a support 8 of insulating material having a front end 9 and a rear end 10. Between said ends 9 and 10 are present on the inside of the support 8 a set of deflection coils 10, 11 for generating a (line) deflection field for the horizontal deflection of an electron beam produced by the electron gun system 3 and on the outside of support 8 a set of coils 12, 13 for generating a (field) deflection field for the vertical deflection of an electron beam generated by the electron gun system 3. The sets of deflection coils 10, 11 and 12, 13 are surrounded by a ring core 14 of a magnetizable material. The individual coils of the sets of coils 10, 11 and 12, 13 are of the saddle type. They are wound so that they generate at least a dynamic dipole field and a dynamic sixpole field.

Figure 2:
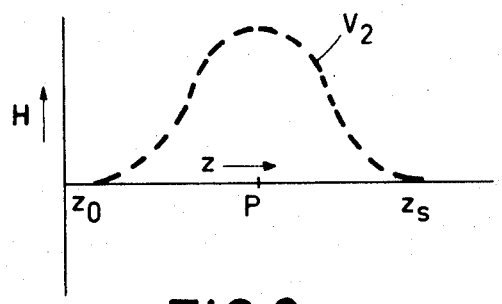
FIG. 2 is a graph of the field strength H of a dipole field $V_2$, which can be generated by the deflection unit shown in FIG. 1, plotted as a function of z.

FIG. 2 shows the amplitude function H(z) of a dipole (field) deflection field $V_2$. In this figure $z_o$ is the entrance side of the deflection area, P denotes the deflection point, and $z_s$ denotes the exit side of the deflection area.

Figure 3:
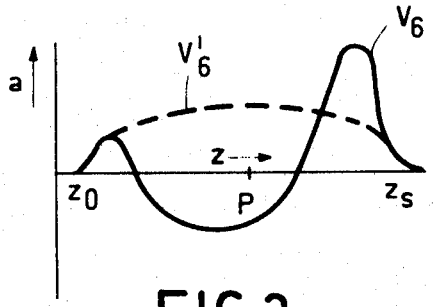
FIG. 3 is a graph of the amplitude a of a sixpole field $V_6$, which can be generated by the deflection unit shown in FIG. 1, plotted as a function of z.

The amplitude function a(z) of the sixpole component $V_6$ of a (field) deflection field is shown in FIG. 3. The sixpole component of the field deflection field is modulated: at $z_o$ it is positive, at P it is negative, and at $z_s$ it is again positive.

A dipole field and a positive sixpole field collectively produce a pin cushion-shaped field; a dipole field and a negative sixpole field collectively produce a barrel-shaped field. The extent of pin cushion and barrel-shape in planes perpendicular to the z axis (the longitudinal) axis of the deflection unit 7 is determined by the value of a.

For illustration of the possibilities presented by the present invention, first the problems are discussed which occur in designing deflection units for monochrome cathode ray tubes of high resolution (so-called Data Graphic Displays or DGD's), in which a larger number of lines per frame is used is usual in combination with higher frequencies.

In that case certain requirements are imposed upon the spot, namely that it should be small in the centre of the screen and that spot deformation occurring upon deflection over the screen should be kept small.

The former requirement can be satisfied by using rotationally symmetrically converged electron beams having a comparatively large opening angle. Since upon deflection the electron beam becomes overfocused as the result of the so-called field curvature, it is customary to use dynamic focusing to correct for this.

Then, however, there is still a spot growth mechanism which results in deterioration of the spot upon deflection over the screen, with a beam having a large opening angle, so that it is difficult to simultaneously satisfy the latter requirement. A further requirement in monochrome D.G.D's is very small north-south and east-west frame distortion.

In the conventional D.G.D. deflection unit which generates substantially homogeneous deflection fields the spot quality can be maintained within acceptable limits, but at the expense of north-south and east-west raster distortion. Although the raster distortion can be compensated for electronically in the deflection circuit while maintaining the spot quality, this solution is not economically attractive. A solution which does not require electronic correction in the deflection circuit comprises the use of strong static magnets on the screen side of the deflection unit for the correction of the raster distortion. However this has the disadvantage that the magnets undesirably influence the spot quality upon deflection.

The invention relates in particular to monochrome D.G.D. deflection units which, without electronic correction in the deflection circuit (not counting, of course, the usual linearity correction and dynamic focusing), both produces a straight north-south and east-west raster and minimizes spot growth upon deflection of the beam over the screen. This is accomplished by modulating the dynamic multipole field so that the electron beam experiences the effect of a pin cushion-like line and field deflection field on the screen—side of the deflection area, and experiences the effect of a barrel-shaped line and field deflection field in the centre of the deflection area. The pin cushion-shaped variation (positive sixpole component) of the combined line and field deflection fields on the screen side influences the north-south and east-west frame distortion by eliminating the pin cushion distortion which occurs with the substantially uniform dipole deflection field generated by the conventional D.G.D. deflection units.

When the line and field deflection fields are homogeneous, they astigmatically produce a large spot deformation. By means of a barrel-shaped variation (negative sixpole component) in the centre of the deflection field, the spot quality can be optimized to minimize astigmatic errors. The field nearer the screen more strongly influences raster distortion, whereas the centre of the field more strongly influences the astigmatic properties. In this manner an equally good spot quality can be achieved all over the screen. A sixpole field component modulated in such manner is denoted by the solid line curve in FIG. 3.

In accordance with the invention, the above and other multipole field modulations are produced by using static multipole fields generated by means of permanently magnetized annular bodies fitting around the display tube or by means of assemblies of permanent magnets arranged coaxially with the longitudinal axis of the display tube, as is shown in FIGS. 4 to 8.

Figure 4:
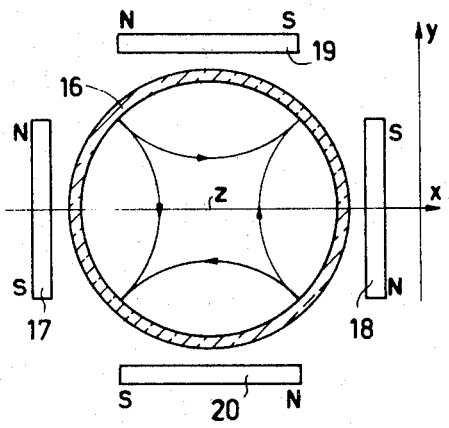
FIG. 4 shows an assembly of four permanent magnets arranged around a tube neck for generating a static quadrupole field.
Figure 5:
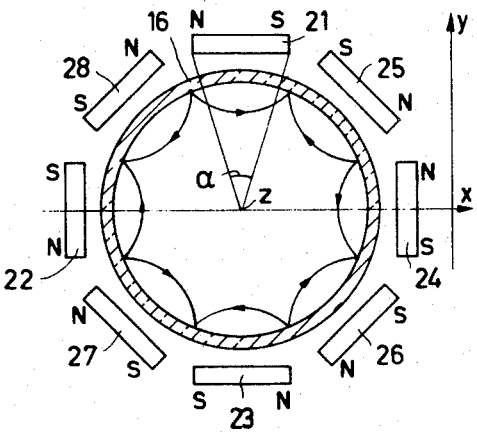
FIGS. 5, 6 and 7 show assemblies of permanent magnets arranged around a tube neck for generating a static eightpole field, a static twelve pole field and a static sixteen pole field, respectively.
Figure 6:
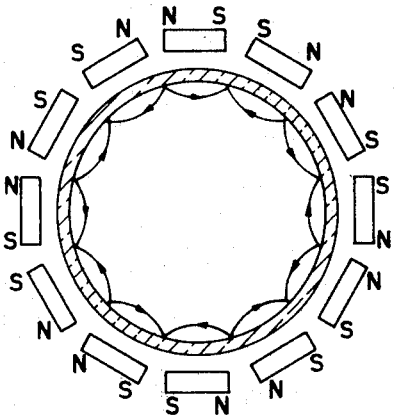
Figure 7:
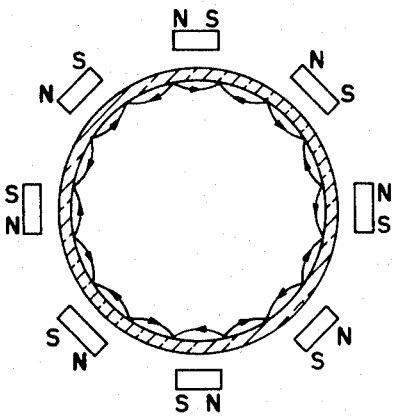

A static quadrupole field as shown in FIG. 4 can be generated by means of two magnets 17, 18, by means of two magnets 19, 20, or by means of the four magnets 17, 18, 19, 20 together. FIG. 4 shows the positioning of the magnets 17, 18, 19, 20 around an envelope of a cathode ray tube 16 shown in cross-section as viewed from the display screen of the cathode ray tube. FIGS. 5, 6 and 7 are drawn correspondingly.

A static eightpole field as shown in FIG. 5 can be generated by means of four magnets 21, 22, 23, 24 placed at equal angular distances coaxially around the longitudinal axis coinciding with the z direction, by means of four magnets 25, 26, 27, 28, or by means of the eight magnets 21 to 28 collectively. An eightpole field having an orientation as indicated by the arrows in FIG. 5 is defined as a negative eightpole field. When the orientation is opposite it is termed a positive eightpole field. For generating a positive eightpole field the magnets should thus have a polarization which is opposite to that of the magnets in FIG. 5.

An eightpole field which does not comprise a sixteen pole field component can be generated by means of eight bar-shaped magnets. (It will be realized that the collective magnet configuration shown in FIG. 5 "does not fit" on the magnet configuration of FIG. 7 which produces a sixteenpole field).

By means of only four bar-shaped magnets, such as the magnets 21, 22, 23, 24, an eightpole field can be generated which does not comprise a sixteen pole field component if the length of the magnets 21, 22, 23, 24 is chosen such that the angle $\alpha$ associated with each of the magnets 21, 22, 23, 24 is the correct value. When the value of $\alpha$ is smaller than that value, a positive sixteen pole field component is introduced, when the value of $\alpha$ is larger than that value a negative sixteen pole field component is introduced.

Figure 16:
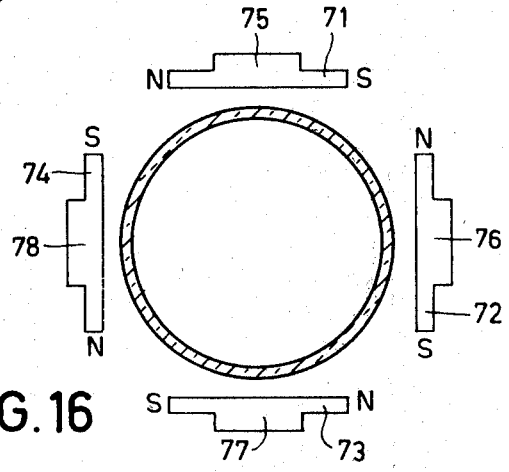
FIG. 16 shows an assembly of four magnets which are arranged about a tube neck and with which a static eightpole field can be generated while suppressing higher harmonic sixteen pole and twenty-four pole components.

Just as the generation of a sixteen-pole field component can be suppressed by a proper choice of the length of the bar magnets, the generation of a twenty-four pole field component can be suppressed by another choice of the length. However, the higher harmonics of the eightpole field cannot be simultaneously suppressed in this manner. Simultaneous suppression can be achieved by using four magnets each having a stepped construction as is shown in FIG. 16. The long limbs 71, 72, 73, 74 of the magnets have such a length that they substantially suppress the generation of a twenty-four pole field component, while a negative sixteen-pole field component is generated to a certain extent. The short limbs 75, 76, 77, 78 have such a length that they also substantially effectively suppressed the generation of a twenty-four pole field component, while a positive sixteen-pole field component is generated to a certain extent. Since there is a positive and a negative contribution to the sixteen-pole field component, it can be suppressed effectively. In this manner, higher order raster and astigmatism errors can be prevented.

It is also possible to generate a static eightpole field by means of two bar-shaped magnets, for example, the magnets 21, 23. Comparison with FIG. 4 makes it clear that a quadrupole field component is then also generated: the configuration of magnets (21, 23) "fits" on the configuration of magnets 19, 20. How this quadrupole component can be compensated for by means of an oppositely oriented quadrupole field in another place in the deflection field will be explained with reference to FIGS. 13*a* and 13*b*.

Figure 9A:
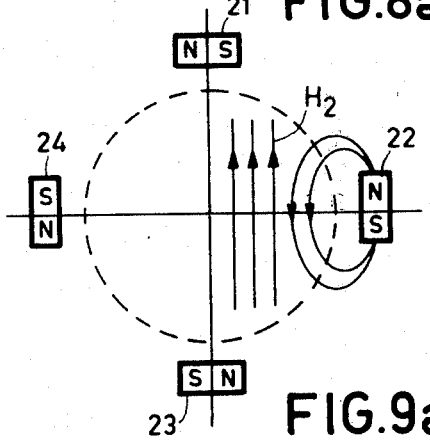
FIGS. 9*a* and 9*b* show the effect of the assembly of FIG. 5 on a line deflection field during two different situations.
Figure 10A:
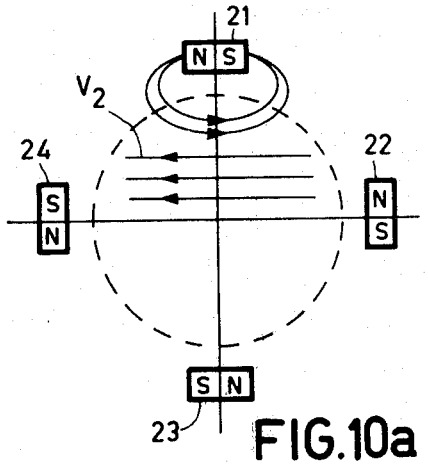
FIGS. 10*a* and 10*b* show the effect of the assembly of FIG. 5 on a field deflection field during two different situations.
Figure 9B:
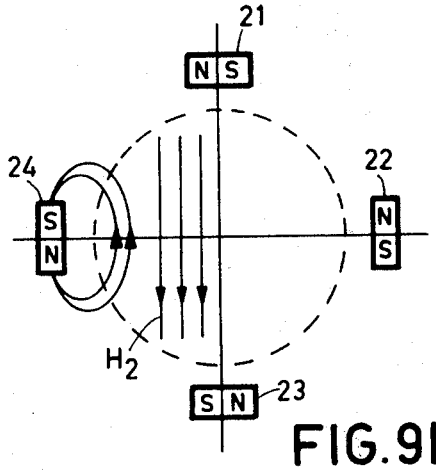
Figure 10B:
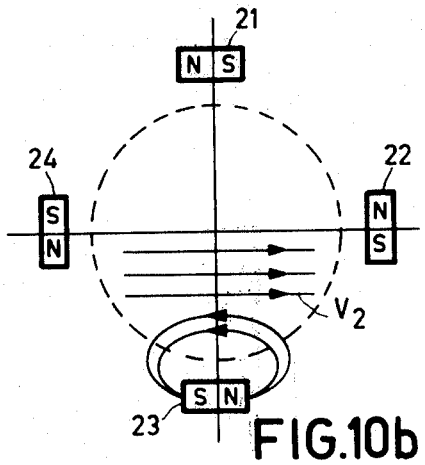

With the addition of the negative static eightpole field of FIG. 5 to a dynamic deflection field, a negative dynamic sixpole field can be produced. This may serve to intensify an already present negative sixpole component or to attenuate an already present positive sixpole component, or even to convert the latter into a negative sixpole. In other words the (line as well as the field deflection field can be made more barrel-shaped. This will be explained with reference to FIGS. 9*a* and 9*b*. During the positive part of the (line) stroke, the line deflection field H2 is directed vertically upwards (FIG. 9*a*) and together with magnet 22 produces a quasi-barrel-shaped field. During the negative part of the (line) stroke the line deflection field is directed downwards vertically (FIG. 9*b*) and together with magnet 24 produce a quasi-barrel-shaped field. An analogous reasoning may be used for the influence of the magnets 21 and 23 on the field deflection field V2 (FIGS. 10*a* and 10*b*). Of course the invention might also have been explained with reference to the magnets 25 to 28 instead of with reference to the magnets 21 to 24.

FIG. 6 shows an assembly of bar-shaped permanent magnets for generating a static twelve-pole field with which a modulation of the dynamic ten-pole component of a deflection field can be produced and FIG. 7 shows an assembly of bar-shaped permanent magnets for generating a static sixteen-pole field with which a modulation of the dynamic fourteen-pole component of a deflection field can be simulated.

Figure 8A:
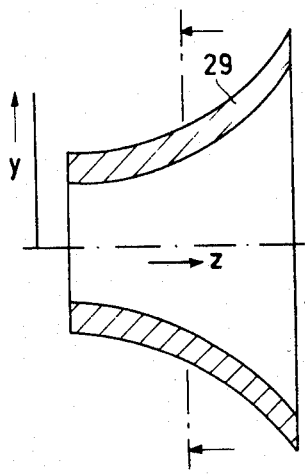
FIG. 8*a* is a cross-sectional view taken along the y-z plane and FIG. 8*b* is a cross-sectional view taken along the x-y plane of a cylindrical core on the inner surface of which an assembly of magnets is provided for generating a static eightpole field.
Figure 8B:
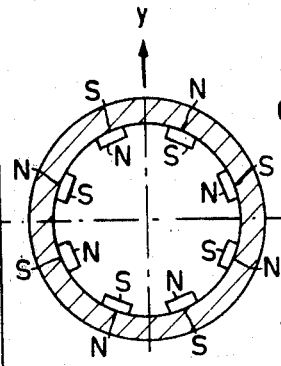

FIGS. 8*a* and 8*b* relate to the use of permanent magnets which are not polarized tangentially, as in the preceding Figures, but radially. This polarization is necessary to prevent the magnetic flux from flowing exclusively through the core 29 when they are located near the inner surface of a cylindrical core 29 of magnetizable material. By way of example the case is shown in which eight separate magnets are located in the centre of the core 29 on the inside, but instead of separate magnets a permanently magnetized ring or band might also be used, for example, while both the number and the axial position of the magnets can be adapted to a specific purpose.

Figure 8C:
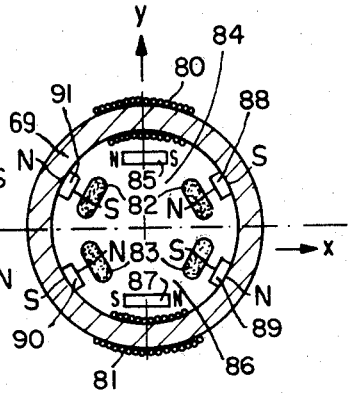
FIG. 8*c* is a cross-sectional view taken along the x-y plane of the same cylindrical core which has an alternative assembly of permanent magnets for generating a static eightpole field.

A space-saving embodiment for the generation of a static eightpole field, comprising combination of radially and tangentially polarized magnets, is shown in FIG. 8*c*. In this case a set of field deflection coils 80, 81 is wound on a ring core 69 while a set of line deflection coils 82, 83 is placed inside the ring core 69. A tangentially polarized magnet 86 is provided in window 84 of line deflection coil 82 and a tangentially polarized magnet 87 is provided in window 86 of line deflection coil 83. At the areas where the field deflection coils 80, 81 do not cover the inner surface of the ring core 69, four radially polarized magnets 88, 89, 90 and 91 are provided between the ring core and the set of line deflection coils 82, 83.

As explained above, the invention provides the ability in monochrome cathode ray tube deflection unit combinations, to considerably reduce the spot growth upon deflection over the display screen, by the addition of a static (negative) magnetic eightpole field in the centre of the deflection area.

Figure 11A:
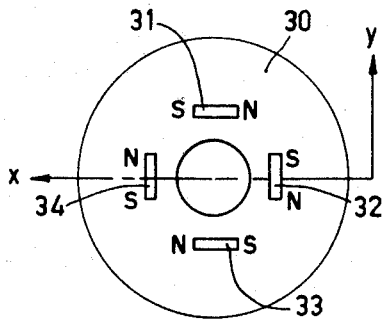
FIGS. 11*a*, 12*a* and 13*a* are rear elevations.

FIGS. 11*a* (rear elevation of a cathode ray tube 30) and 11*b* (side elevation of a cathode ray tube 30) the magnet locations show an embodiment including four permanent magnets 31, 32, 33, 34. For the sake of clarity the deflection unit itself it not shown in this Figure.

Figure 12A:
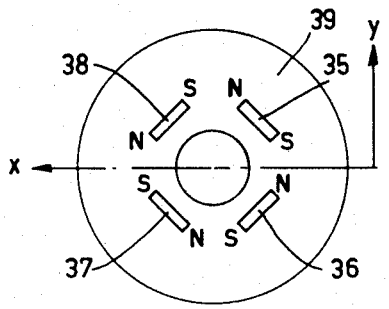
Figure 12B:
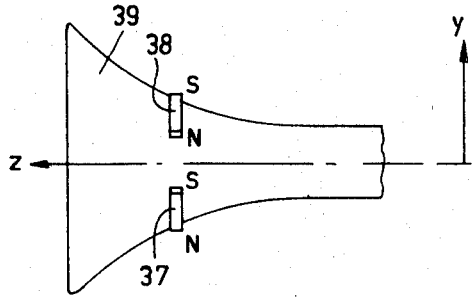
Figure 13A:
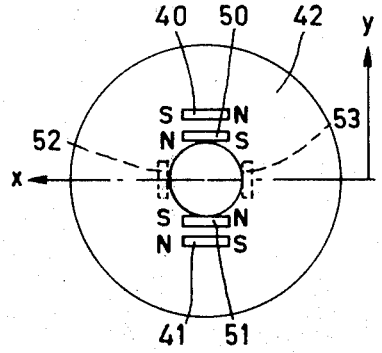
Figure 13B:
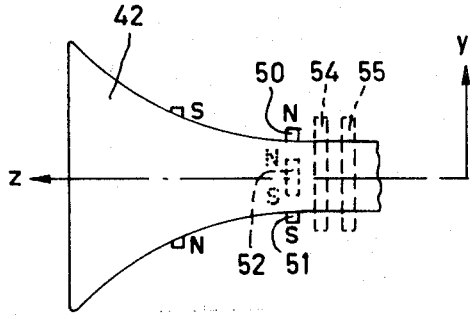

In a corresponding manner, FIGS. 12*a* and 12*b* show the location of an assembly of four permanent magnets 35, 36, 37 and 38 with respect to a cathode ray tube 39, and FIGS. 13*a* and 13*b* show the locations of two magnets 40 and 41 with respect to a cathode ray tube 42. The latter embodiment is useful when the "spot reduction" magnets must be provided after the deflection unit is assembled (for example upon trimming) and only the window of the line deflection coils presents accessible space. Magnets 40, 41 can be provided in that stage, but additional magnets, like those corresponding to magnets 32 and 24 in FIG. 5, cannot.

Figure 14:
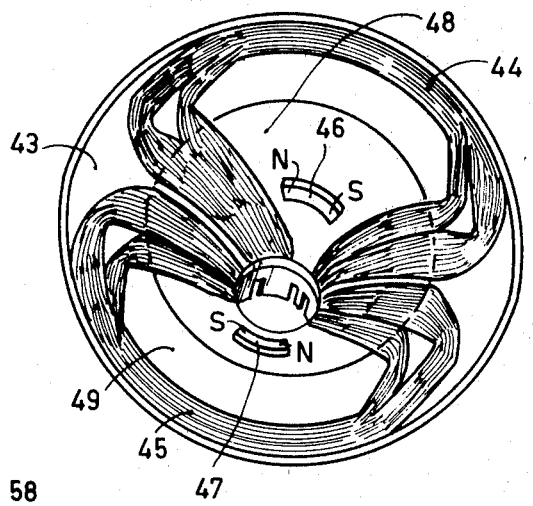
FIG. 14 is a perspective front elevation of a support which supports a set of line deflection coils and has an assembly of permanent magnets according to the invention.

FIG. 14 shows a support 43 of synthetic resin which supports a first line deflection coil 44 and a second line deflection coil 45. Line deflection coil 44 has a window 48 which leaves space to subsequently attach a magnet 46 on the support 43, and line deflection coil 45 has a window 49 which leaves space to subsequently attach a magnet 47. The magnets do not only generate an eightpole field, but also a quadrupole field. In order to compensate for this quadrupole field, a set of magnets 50, 51 or 52, 53 which generate a quadrupole field of opposite orientation may be provided on the entrance side of the deflection area, (FIG. 13*a*). Alternatively, compensation for the undesired quadrupole field can be accomplished by the use of two rotatable rings 54 and 55 which are magnetized as quadrupoles and which are provided between the centre of the deflection unit and the electron gun system. A quadrupole field of a desired strength can be obtained by means of the rings 54 and 55 with which both the undesired quadrupole fields of the "spot" magnets 40, 41 and astigmatism errors originating from imperfections in the electron gun system can be compensated for. If quadrupole rings are already used, only the magnets 40, 41 need be added for spot reduction.

Figure 11B:
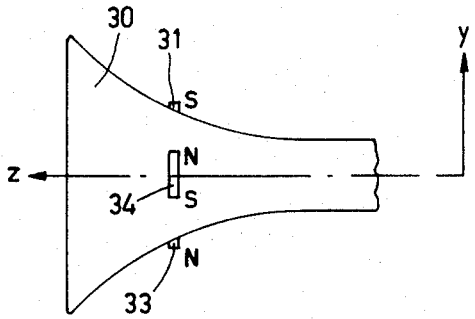
FIGS. 11*b*, 12*b* and 13*b* are side elevations of cathode ray tubes on which assemblies of permanent magnets according to the invention are positioned.
Figure 15:
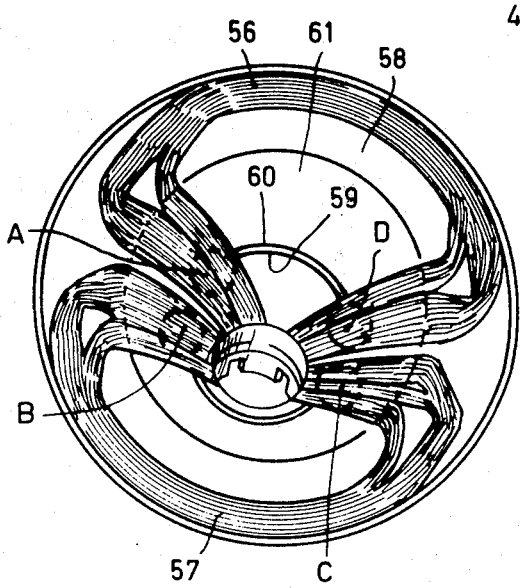
FIG. 15 is a perspective front elevation of a support which supports a set of line deflection coils and has three rings magnetized as a multipole according to the invention.

When spot reduction magnets can be provided, during assembly of the deflection unit, the configuration of four magnets shown in FIGS. 11*a* and 11*b* is preferred. It is then possible to fix them behind the axially extending conductor bundles of the line deflection coils, for example, in places denoted by A, B, C and D in FIG. 15. In addition to line deflection coils 56 and 57, FIG. 15 shows a support 58 of synthetic resin including a groove 59 in which a ring 60 magnetized as a multipole is accommodated.

In the production of deflection units for large screen colour television systems there is often a very large spread of the "isotropic" line astigmatism and of the anisotropic Y-astigmatism.

As indicated above, astigmatism can be influenced by means of suitable static magnetic fields. The maximum sensitivity for astigmatism is found approximately in the centre of the deflection area where the influence on coma and raster distortion is minimum.

In one embodiment of the invention, the deflection unit includes a ring 60 of permanent magnetizable material located approximately in the centre of the deflection unit. In the final phase of the production ring 60 can be magnetized so that "optimum" convergence is obtained. The astigmatism errors which are generated by spreading of line deflection coils, during manufacture and/or the set of frame deflection coils, are influenced by the static field in such manner that the errors are partly compensated for or are partly "spread" over the screen. The way in which the ring 60 is magnetized thus depends on the manufacturing tolerances of the deflection units and hence differs for each individual deflection unit.

A list of multipole static magnetic fields and the types of errors for which they are best suited to correct, is given below. All the fields may be used in combination.

| Static multipole | | |
|---|---|---|
| multipole | distribution | Main action on: |
| 4-pole | $(R^2 \sin \phi)$ | isotropic line astigmatism |
| 8-pole | $(R^4 \sin \phi)$ | anisotropic Y-astigmatism |
| 8-pole | $(R^4 \cos \phi)$ | diagonal asymmetries of the astigmatism. |

If desired, static multipole fields of still higher order may be used for correction or reduction of higher order errors of astigmatism.

A particular aspect of the invention will be described in detail hereinafter while referring to FIG. 3. When a set of deflection coils are wound so that they generate a positive sixpole field $V_6^1$, as indicated by the broken-line curve in FIG. 3, the addition of a negative static eightpole field in the central area of the deflection field (near the deflection point P) has a particular effect. This static eightpole field has a stronger effect on spot errors than on raster errors. In the centre the static eightpole field effects such a strong attenuation of the positive sixpole field that a negative sixpole is formed (which ensures an optimum spot quality). But the attenuation is much less strong with reference to the raster so that the effect on the raster corresponds to a positive sixpole field which is indented slightly in the centre. The correcting influence of the positive dynamic sixpole field on raster errors begins sooner than with a sixpole field modulation as indicated by the solid-line curve in FIG. 3, as a result of which the occurrence of higher order raster errors are substantially avoided. The positive dynamic sixpole field can be simply produced by a toroidally wound set of deflection coils. The invention may also be used advantageously with hybrid deflection units.

What is claimed is:

1. A cathode ray display tube assembly comprising an envelope, an electron gun system mounted in said envelope for producing at least one electron beam, and a deflection unit mounted on the envelope defining a deflection area within the envelope;

said deflection unit comprising a set of line deflection coils for effecting deflection of the electron beam in a first direction, a set of field deflection coils for effecting deflection of the electron beam in a direction transverse to the first direction, and permanent magnet means arranged coaxially with a longitudinal axis of the deflection unit;

said sets of deflection coils being arranged to produce a dynamic magnetic multipole field having a dipole component and an $n-2$ pole component, and said permanent magnet means being arranged to produce a static n pole field for modulating the $n-2$ pole component of the dynamic field, where n is equal to 4, 8, 12 or 16.

2. A cathode ray tube as in claim 1, characterized in that the permanent magnet means comprises at least two permanent magnets placed tangentially along the circumference of a circle having its center lying on the longitudinal axis of the deflection unit.

3. A cathode ray tube as in claim 1, characterized in that the permanent magnet means comprises an annular member arranged coaxially with the longitudinal axis of the deflection unit said member having at least two north poles and two south poles.

4. A cathode ray tube as in claim 3 including a support of synthetic resin which supports at least one of the sets of deflection coils, said support having a groove in which the annular member is situated.

5. A cathode ray tube as in claim 3 including a core of magnetizable material surrounding at least the set of line deflection coils, said annular member being situated against an inner surface of said core.

6. A cathode ray tube as in claim 1, 2, 3, 4 or 5, characterized in that the permanent magnet means is arranged to produce an eightpole field in the central region of the deflection area.

7. A cathode ray tube as in claim 6, characterized in that at least one of the sets of deflection coils is arranged to produce a positive dynamic sixpole field component along the whole length of the deflection area.

8. A cathode ray tube as in claim 7, characterized in that one of the sets of deflection coils is wound toroidally on a core of magnetizable material.

9. A cathode ray tube as in claim 6, characterized in that the permanent magnet means includes four permanent magnets.

10. A cathode ray tube as in claim 9, characterized in that the magnets have lengths which effects generation of an eightpole field without generating a sixteen-pole field component.

11. A cathode ray tube as in claim 6, characterized in that the permanent magnet means includes two permanent magnets which generate an eightpole field and a first quadrupole field, and a permanent magnet correction device at a beam entrance side of the deflection area which generates a second quadrupole field which is polarized to oppose the first quadrupole field.

12. A cathode ray tube as in claim 11, characterized in that the correction device includes two permanent magnets.

13. A cathode ray tube in claim 11, characterized in that the correction device comprises two rings of permanent magnetizable material of which at least one is rotatable about its centre, said rings having two north-poles and two south-poles.

14. A deflection unit for a cathode ray display tube of the type comprising an envelope and an electron gun system mounted in said envelope for producing at least one electron beam, the deflection unit being adapted for mounting on the envelope to define a deflection area within the envelope;

said deflection unit comprising a set of line deflection coils for effecting deflection of the electron beam in a first direction, a set of field deflection coils for effecting deflection of the electron beam in a direction transverse to the first direction, and permanent magnet means arranged coaxially with a longitudinal axis of the deflection unit;

said sets of deflection coils being arranged to produce a dynamic magnetic multipole field having a dipole component and an n-2 pole component, and said permanent magnet means being arranged to produce a static n pole field for modulating the n-2 pole component of the dynamic field, where n is equal to 4, 8, 12 or 16.

15. A deflection unit as in claim 14, characterized in that the permanent magnet means comprises at least two permanent magnets placed tangentially along the circumference of a circle having its center lying on the longitudinal axis of the deflection unit.

16. A defection unit as in claim 14, charaterized in that the permanent magnet means comprises an annular member arranged coaxially with the longitudinal axis of the deflection unit, said member having at least two north poles and two south poles.

17. A deflection unit as in claim 16 including a support of synthetic resin supporting at least one of the sets of deflection coils, said support having a groove in which the annular member is situated.

18. A deflection unit as in claim 16 including a core of magnetizable material surrounding at least the set of line deflection coils, said annular member being situated against an inner surface of said core.

19. A deflection unit as in claim 14, 15, 16, 17 or 18, characterized in that the permanent magnet means is arranged to produce an eightpole field in the central region of the deflection area.

20. A deflection unit as in claim 19, characterized in that at least one of the sets of deflection coils is arranged to produce a positive dynamic sixpole field along the whole length of the deflection area.

21. A deflection unit in claim 20, characterized in one of the sets of deflection coils is wound toroidally on a core of a magnetizable material.

22. A deflection unit as in claim 19, characterized in that the permanent magnetic means includes four permanent magnets.

23. A deflection unit as in claim 22, characterized in that the magnets have lengths which effect generation of an eightpole field without generating a sixteen pole field component.

24. A deflection unit as in claim 19, characterized in that the permanent magnet means includes two permanent magnets which generate an eightpole field and a first quadrupole field, and a permanent magnet correction device at a beam entrance side of the deflection area which generates a second quadrupole field which is polarized to oppose the first quadrupole field.

25. A deflection unit as in claim 24, characterized in that the correction device includes two permanent magnets.

26. A deflection unit as in claim 24, characterized in that the correction device comprises two rings of a permanent magnetizable material of which at least one is rotatable about its centre, said rings having two north poles and two south poles.

* * * * *